US005115629A

United States Patent [19]

Zumfeld

[11] Patent Number: 5,115,629

[45] Date of Patent: May 26, 1992

[54] METHOD AND APPARATUS FOR PREPARING YARN ENDS TO BE SPLICED

[75] Inventor: Heinz Zumfeld, Mönchengladbach, Fed. Rep. of Germany

[73] Assignee: W. Schlafhorst AG & Co., Mönchengladbach, Fed. Rep. of Germany

[21] Appl. No.: 660,644

[22] Filed: Feb. 25, 1991

[30] Foreign Application Priority Data

Feb. 23, 1990 [DE] Fed. Rep. of Germany ..... 4005752

[51] Int. Cl.[5] ..... D01H 15/013; B65H 69/06

[52] U.S. Cl. ..... 57/22; 57/261; 242/35.6 R

[58] Field of Search ..... 57/22, 261, 263; 289/2; 242/35.6 R

[56] References Cited

U.S. PATENT DOCUMENTS

| | | | |
|---|---|---|---|
| 4,528,808 | 7/1985 | Luz | 57/22 |
| 4,538,407 | 9/1985 | Matsui et al. | 57/22 |
| 4,549,392 | 10/1985 | Kimura | 57/22 |
| 4,566,260 | 1/1986 | Irmen | 57/22 |
| 4,570,427 | 2/1986 | Premi et al. | 57/22 |
| 4,610,133 | 9/1986 | Rohner et al. | 57/22 |

*Primary Examiner*—Daniel P. Stodola
*Assistant Examiner*—Michael R. Mansen
*Attorney, Agent, or Firm*—Herbert L. Lerner; Laurence A. Greenberg

[57] ABSTRACT

In a method and apparatus for preparing yarn ends, two yarns to be joined together by pneumatic splicing are placed in a splicer head of a splicer at a given instant with ends of the yarn to be prepared protruding out of a splicing channel of the splicer head in mutually opposite directions. The yarn ends are held taut at given points. The yarn ends protruding from the splicing channel are shortened to a length required for a splicing process by cutting off portions of the yarn ends between the given points and the splicer head and producing cut edges. The yarn ends to be prepared are aspirated with the cut edges leading into respective preparation nozzles at a predetermined speed. Twists in the yarn ends beginning at the cut edges are pneumatically unravelled with compressed air during the aspiration into the preparation nozzles. Locations of the yarns in the splicing channel are maintained relative to one another and to the splicing channel from the given instant until the pneumatic unraveling is completed. The yarn ends are aspirated far enough to prepare a yarn length for splicing being optimally matched to applicable yarn parameters while a not-unraveled portion of the yarns remains stationary in the splicing channel. The duration and intensity of preparation of the yarn ends are adapted to the yarn parameters.

12 Claims, 6 Drawing Sheets

METHOD AND APPARATUS FOR PREPARING YARN ENDS TO BE SPLICED

Figure 1:
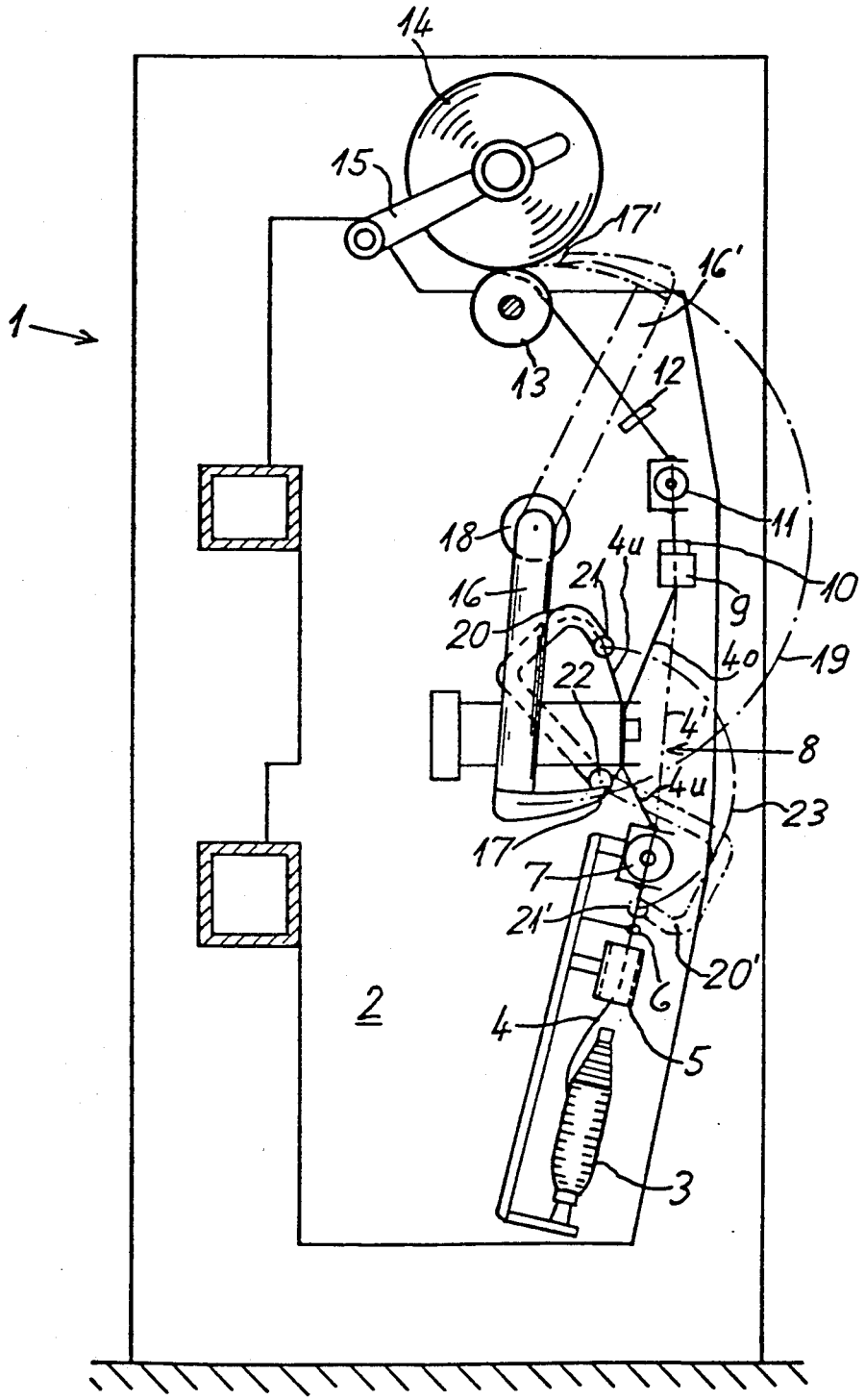

The invention relates to a method for preparing two yarn ends to be joined together in a splicer by pneumatic splicing, which includes pneumatically unraveling a yarn twist in a preparation nozzle; placing the yarns in a splicer head of the splicer with the yarn ends to be prepared protruding out of a splicing channel of the splicer head in mutually opposite directions; holding each of the yarn ends taut; and shortening the yarn ends protruding from the splicing channel to a length required for a splicing process by cutting off end portions between a point where they are each held and the splicer head. The invention also relates to an apparatus for performing the method in a splicer for pneumatically splicing yarn ends, including a splicer head with a splicing channel receiving the yarn ends to be spliced, cutting tools for cutting off end portions of the yarn ends, and preparation nozzles disposed above and below the splicer head for pneumatically unraveling the yarn twist.

The appearance and quality of a splice depend substantially on the preparation of the yarn ends. Yarn connections that do not differ substantially in appearance and strength from the rest of the yarn, result only if the yarn ends are optimally prepared. For this reason, particular care is taken in the preparation of the yarn ends.

Pneumatically unraveling the yarn twist in a preparation nozzle is known from the prior art. To this end, the yarn end is aspirated into a small tube, and the yarn twist is undone and loose fibers are blown away by means of compressed air aimed at the yarn end, thereby producing a so-called unraveled yarn end with as many parallel fibers as possible, which are pneumatically spliced to the fibers of the other yarn end. An optimal splice is not attained until the yarn ends have been prepared in a form and length that are matched to the particular yarn parameters. It is also known to provide preparation nozzles for pneumatically unraveling the yarn twist, which can be displaced in the axial direction by being screwed in and out. Such preparation nozzles are known from German Patent DE-PS 32 11 038. In order to convert to a different yarn batch, resetting of the preparation nozzles is also necessary. To this end, all of the splicers of a machine that are intended for the resetting must be reset by the same length, by screwing the preparation nozzles inward or outward.

Depending on the length by which the cylindrical tubes protrude from the yarn splicer, a more or less long yarn end is prepared. Since the preparation nozzles are disposed just above the splicer head, the piece of yarn traveling past the suction opening of the preparation nozzle is first engaged and is then aspirated in the form of a loop into the preparation nozzle. As a rule, the aspiration is effected by blowing in the compressed air that is aimed at the yarn end in order to unravel the yarn twist. However, if the jet of compressed air that is intended to unravel the yarn twist first strikes the aspirated yarn loop, the fibers are blown into the portion of the yarn end that has not yet been unraveled, with the danger that non-uniform unraveling of the yarn end will occur. As a result, the location of the yarn end that is first impacted by the unraveling jet of compressed air ca become thinner than the rest of the composite yarn structure, particularly in the vicinity of the aspirated loops. The danger of such an occurrence is that both the strength and the appearance of the splice may be impaired.

Aspirating the yarn ends into the preparation nozzles can be controlled through a loop puller that pulls the prepared yarn ends into the splicing channel. Since the loop pulled is located behind the splicer head, as viewed from the direction of the yarn end, the yarns in the splicing channel have to slide past one another. With yarns that lack a smooth surface, or in other words with bushy, rough and furry yarns, there is the danger that the fibers protruding from the surfaces of the yarn will catch in one another as they move past one another. That results in increased frictional forces, which prevent unhindered aspiration of the yarn ends. In turn, that can lead to the aspiration of different yarn lengths into the yarn end preparation nozzles, and as a result different yarn lengths may be prepared. If the prepared yarn ends are then pulled out of the preparation nozzles into the splicing channel for the splicing process, the two yarn ends may be unraveled to different lengths. An ensuing splicing process may produce a non-uniform splice.

It is accordingly an object of the invention to provide a method and apparatus for preparing yarn ends to be spliced, which overcome the hereinafore-mentioned disadvantages of the heretofore-known methods and devices of this general type and with which optimal unraveling of the yarn ends for preparation for pneumatic splicing is attained.

With the foregoing and other objects in view there is provided, in accordance with the invention, a method for preparing two yarn ends to be joined together, which comprises placing two yarns to be joined together by pneumatic splicing in a splicer head of a splicer at a given instant with ends of the yarn to be prepared protruding out of a splicing channel of the splicer head in mutually opposite directions; holding the yarn ends taut at given points; shortening the yarn ends protruding from the splicing channel to a length required for a splicing process by cutting off portions of the yarn ends between the given points and the splicer head and producing cut edges; aspirating the yarn ends to be prepared with the cut edges leading into respective preparation nozzles at a predetermined speed; pneumatically unravelling twists in the yarn ends beginning at the cut edges with compressed air during the aspiration into the preparation nozzles; maintaining locations of the yarns in the splicing channel relative to one another and to the splicing channel from the given instant until the pneumatic unraveling is completed; aspirating the yarn ends far enough to prepare a yarn length for splicing being optimally matched to applicable yarn parameters while a not-unraveled portion of the yarns remains stationary in the splicing channel; and adapting a duration and intensity of preparation of the yarn ends to the yarn parameters.

With the objects of the invention in view, there is also provided, in a splicer for pneumatically splicing yarn ends, including a splicer head with a splicing channel for receiving yarn ends to be spliced, cutting tools for cutting off end portions of the yarn ends at a given point along each of the yarn ends and at a given instant of actuation, and preparation nozzles having suction openings and being respectively disposed above and below the splicer head for pneumatically unraveling a yarn twist, an apparatus for preparing two yarn ends to be joined together, comprising means for locating the preparation nozzles directly at the cutting tools and between the cutting tools and the splicer head at least at the given instant of actuation, with each of the suction openings aimed directly at a respective one of the given points.

In contrast to the prior art, the aspiration of the yarn end into the preparation nozzle no longer takes place through an aspirated loop of yarn. To this end, the suction opening of the preparation nozzle is disposed directly on the cutting tool, and the suction opening is aimed at the point of the yarn at which it is severed. When the cutting tool is put into operation, suction simultaneously prevails at the suction opening of the preparation nozzle. The way in which such suction is generated in the preparation nozzle is known from the prior art. If the yarn is then severed, its end to be prepared is immediately engaged by the suction and is aspirated into the preparation nozzle at a predeterminable speed, with the cut edge leading. The particular advantage of the invention is that preparation of the yarn end, that is the pneumatic unraveling of the yarn twist, progresses, beginning at the cut edge, along with the aspiration of the yarn end into the preparation nozzle. All of the loose fibers are engaged directly by the suction and removed by it. They can no longer back up from a loop at the as-yet unprepared yarn end and hinder the unraveling process, as in conventional preparation methods. Unraveling of the yarn end is effected only to the length to which the yarn has been aspirated into the preparation nozzle and subjected to the unraveling airflow.

While the yarn ends are aspirated into the preparation nozzles, the location of the yarns in the splicing channel is unchanged. They remain stationary in the splicing channel during the preparation process, from the instant of placement in the splicing channel. As a result, the two yarn ends need not move past one another upon aspiration into the preparation nozzles and therefore they do not hinder one another. If they did, the result would be that different yarn lengths would be aspirated.

By specifying the length that can be aspirated, the yarn length to be prepared for splicing can be optimally matched to the yarn parameters. The duration and intensity of the airflow that acts upon the yarn end to be prepared can also be adapted to the yarn parameters. When preparing yarn ends in the manner used according to the prior art, unnecessarily high pressures are necessary, because the yarn ends are aspirated into the preparation nozzles through a loop and are unraveled from the loop. If the yarn ends are aspirated beginning at their cut edge and then unraveled, a substantially lower pressure suffices. For instance, while approximately 6 to 7 atmospheres are needed in the conventional methods for a standard-twist cotton yarn of approximately 10 Nm, in the preparation according to the method of the invention, only 2.5 to 3 atmospheres are necessary. If the compressed air used for preparing is at lower pressures, substantially gentler, better and more uniform unraveling of the yarn ends takes place.

The aspiration of the yarn end to be prepared into the preparation nozzle can be accomplished as follows:

Before the end portions of the yarn ends are cut off, the preparation nozzles are each disposed in a position directly below the cutting tools, between the cutting tool and the splicer head. The suction openings of the preparation nozzles are oriented toward the cutting tools. Even before the end portions are severed, a suction flow is present at the suction openings. The result is that after the en portions have been severed, the yarn ends are aspirated with their cut edge leading into the preparation nozzles. It is advantageous that the preparation for the two yarn ends to be spliced proceeds simultaneously. As a result, the ensuing method steps can be performed simultaneously by the same apparatus. The suction openings of the preparation nozzles are moved toward the splicer head at a predeterminable speed, covering approximately the distance that had previously been occupied by the tautly held yarn ends between the cutting tools and the splicer head. The yarn ends to be prepared are aspirated by the suction, move deeper and deeper into the preparation nozzles and at the same time are freed of their yarn twist by the blown-in compressed air. The motion of the preparation nozzles can be stopped whenever the particular optimal yarn length for preparing the yarn ends has been aspirated. Once the yarn end preparation has been completed, the prepared yarn ends can be pulled into the splicing channel of the splicer head in a known manner by loop pullers. The splice is then made there by the pneumatic splicing process.

The motion of the suction openings of the preparation nozzles can be achieved in two variant methods.

The first variant method includes swiveling the suction openings of the preparation nozzles out of their position below the cutting tools toward the splicer head. The pivot points of the preparation nozzles are each located between the cutting tool and the splicer head. They may, however, also be located at the level of the upper or lower edge of the splicer head. In the rotation of a suction opening out of the position below the cutting tool toward the splicer head, the yarn end to be prepared is aspirated farther into the preparation nozzle with increasing swiveling. The swiveling motion of the preparation nozzle can then be stopped whenever an optimal yarn length for preparation has been aspirated into the preparation nozzle.

During the yarn end preparation, the preparation nozzles must not be pivoted any farther than to where the oppositely oriented components of the motions of the suction opening and the yarn do not reverse direction. During the aspiration of a yarn end into a preparation nozzle, the yarn and the suction opening move toward one another. During the swiveling of the preparation nozzles toward the splicer head, the paths of the suction openings, which as a rule are in the form of a circular arc, must not have a second intersection with the particular path of the yarn that it had assumed between the splicer head and the cutting tool prior to the preparation. If the yarn path were a secant of the path of the suction opening, then from the intersection point where the secant leaves the circular arc, yarn would be pulled out of the preparation nozzle upon further swiveling past that point. The same phenomenon would occur if the suction nozzle were pivoted outward past the point of maximum proximity between the yarn path and the path of the suction opening. The danger exists that when the yarn is pulled out of the preparation nozzle during the preparation, a non-uniformly prepared yarn end would result.

According to the second method variant, the preparation nozzles are displaced out of their aspiration position below the cutting tools toward the splicer head in such a way that the suction openings substantially follow the particular paths or courses of the previously tautly held yarn ends. In this motion, the yarn end to be prepared also moves inward into the preparation nozzle with increasing proximity of the preparation nozzle to the splicer head. In this method variant as well, the yarn end is aspirated into the preparation nozzle with its cut edge first and there is exposed to the air flow that unravels the yarn twist, with the yarn end being unraveled beginning at its cut edge. The unraveling of the yarn twist progresses with increasing aspiration of the yarn end. The displacement of the preparation nozzle in each case can be performed far enough to ensure that a length that is optimal for purposes of preparing the yarn end has been aspirated. According to a further mode of the method, the preparation nozzles are pivoted or displaced far enough after completion of the preparation of the yarn ends to ensure that the suction openings are each located directly above or below the splicer head, facing the particular end of the splicing channel. The suction continues to prevail at the suction openings, while the prepared yarn ends are pulled out of the preparation nozzles and into the splicing channel, and the splicing process is performed. If the yarn ends continue to be aspirated after the preparation, then it is possible to securely introduce even difficult-to-handle yarns, such as thin, light yarns that tend to kink, and to splice them. The yarn ends can always be guided in a controlled manner.

According to another variant of the method, prior to cutting off the end portions having the remaining yarn ends that protrude from the splicer head, a loop is pulled between each of the cutting tools and the splicer head, and each loop includes a yarn length that is equivalent to the yarn length to be prepared for splicing. Once the end portions have been cut off, the loops are unraveled in such a way that the yarn ends to be prepared are aspirated into the respective preparation nozzles, with their cut edge leading and having the yarn length to be prepared. In this exemplary embodiment, the two preparation nozzles remain stationary. They are disposed directly below the cutting tools, in other words between the cutting tool and the splicer head, and their suction openings are each aimed at the point on the yarns at which the yarns are severed. There is one loop puller between each of the cutting tools and the splicer head. After engaging the end of the yarn, the loop puller pulls the yarn end vertically or nearly vertically out of the path taken by the yarn end between the cutting tool and the splicer head. While the end portion of the yarn is severed and suction is simultaneously applied to the suction opening of the preparation nozzle, the loop puller is moved in such a way that the yarn loop is loosened, and the yarn end to be prepared is aspirated into the preparation nozzle with its cut edge leading. During this process the yarn loop unravels. This variant method makes it possible to provide a compact splicer structure, since the spacing distance between the cutting tool and the splicer head can theoretically be reduced to the thickness of the loop puller. Since the loop puller is actuated perpendicularly o approximately perpendicularly relative to the yarn path or course, it requires no more than a little space.

Once the yarn ends to be spliced have been sufficiently well prepared, the loop puller that is already known from the prior art goes into action and pulls the prepared yarn ends out of the preparation nozzles into the splicing channel of the splicer head. These loop pullers are not identical to the loop pullers of the previous exemplary embodiment. They are each disposed on the side of the splicer head opposite the prepared yarn end, in the yarn path. If the prepared yarn ends in the splicing channel in the splicer head are located side by side, then they can be joined by the splicing method known from the prior art.

Other features which are considered as characteristic for the invention are set forth in the appended claims.

Although the invention is illustrated and described herein as embodied in a method and apparatus for preparing yarn ends to be spliced, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 2:
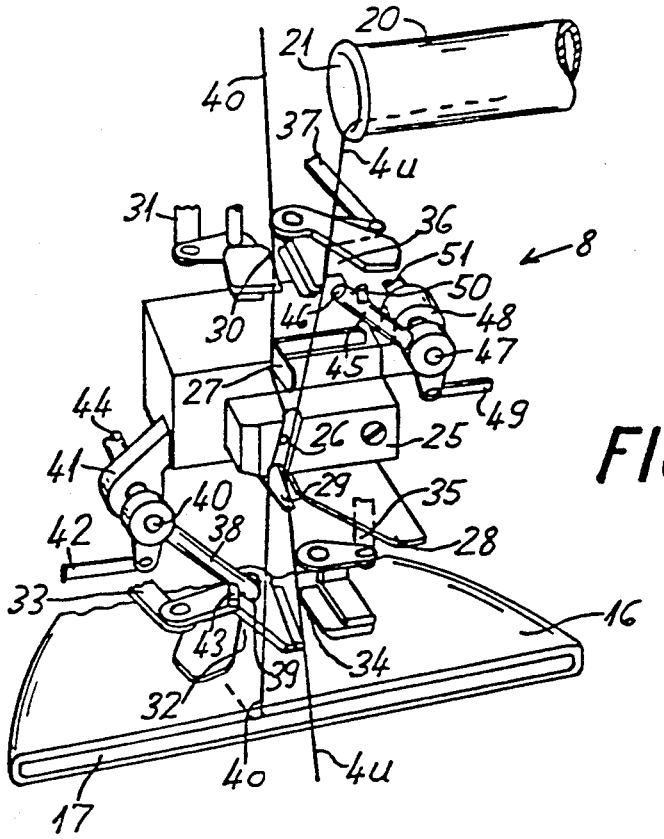
Figure 3:
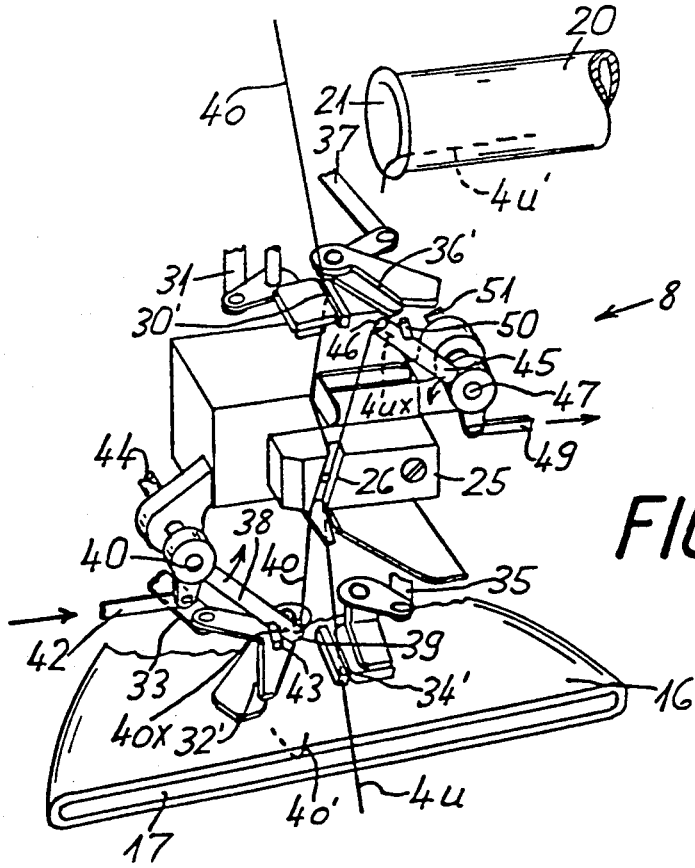
Figure 4:
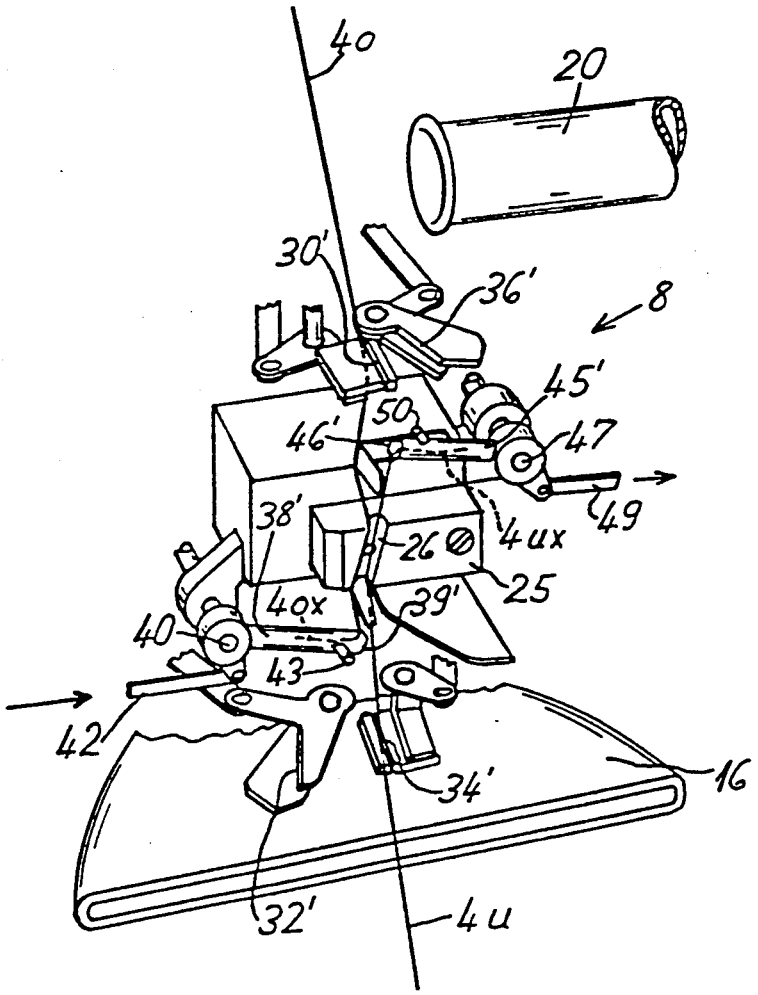
Figure 5:
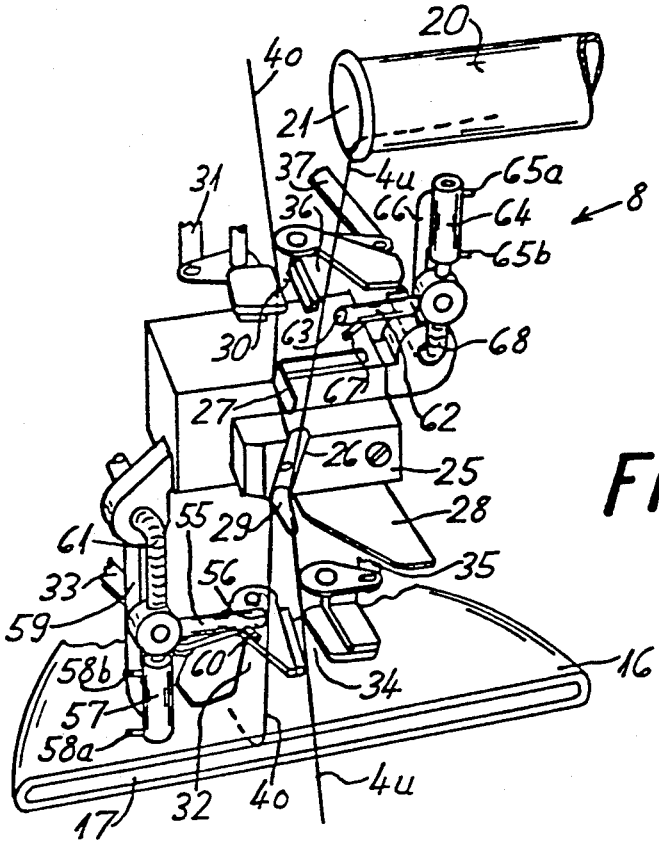
Figure 6:
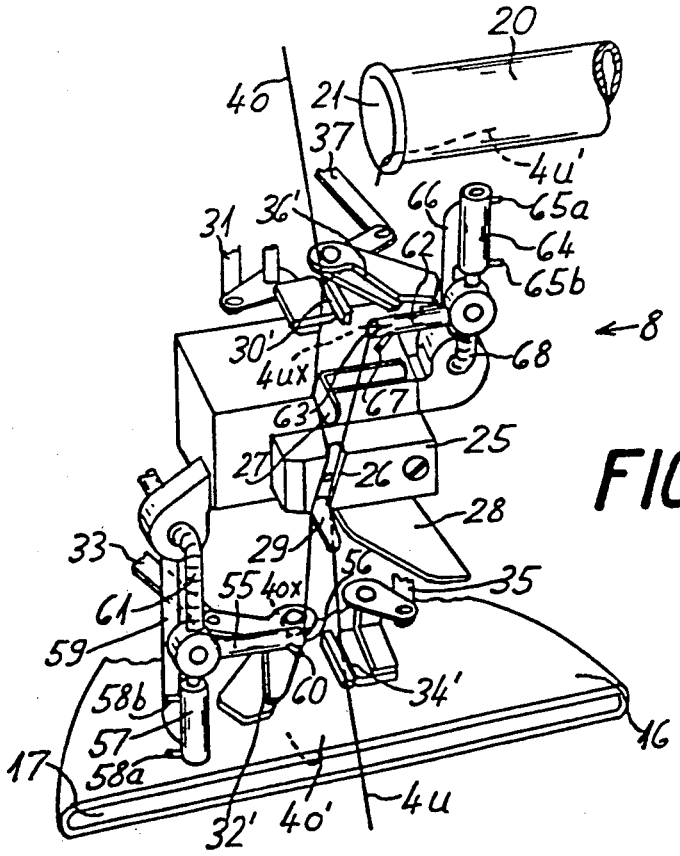
Figure 7:
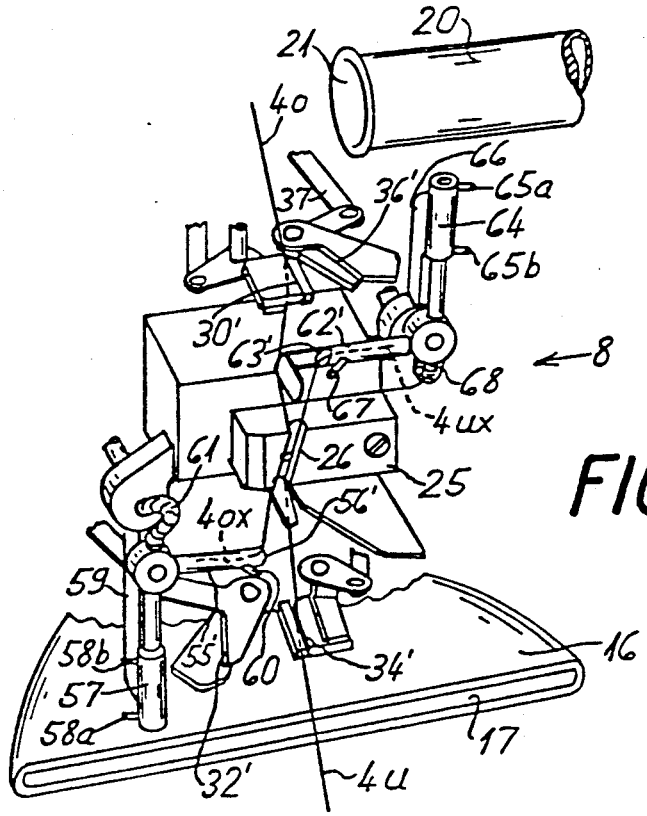
Figure 8:
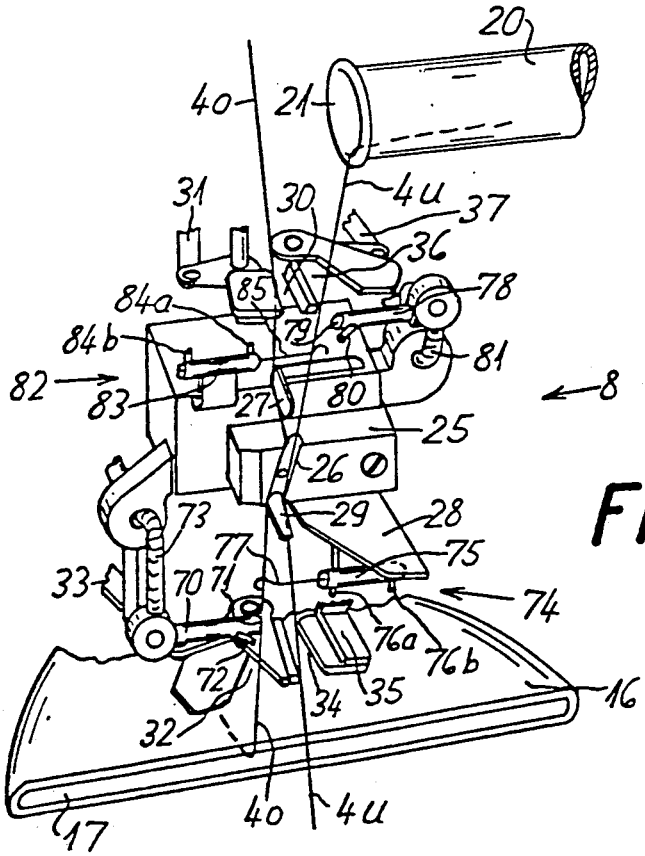
Figure 9:
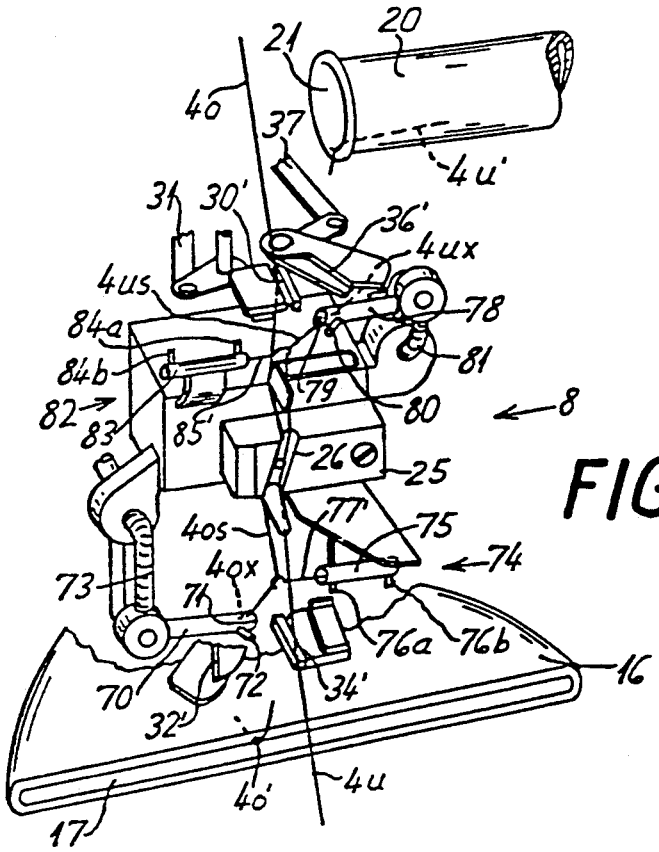
Figure 10:
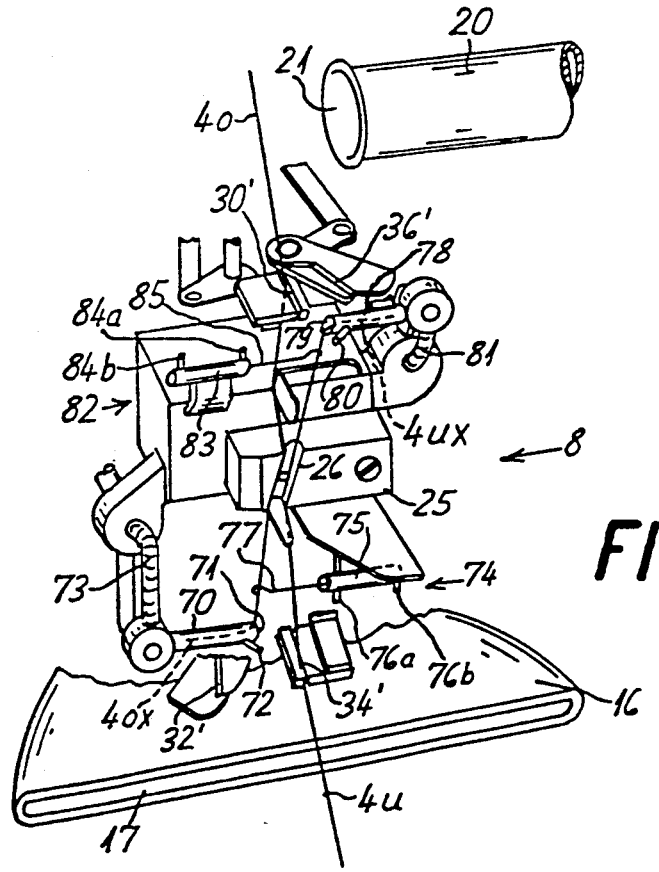

FIG. 1 is a diagrammatic, partly sectional, side-elevational view of a bobbin winder with a splicer for performing the method according to the invention;

FIGS. 2, 3 and 4 are fragmentary, perspective views of an exemplary embodiment having pivotable preparation nozzles, and FIGS. 5, 6 and 7 are fragmentary, perspective views of an exemplary embodiment with displaceable preparation nozzles, wherein FIGS. 2 and 5 show a situation after placement of yarns in the splicer, FIGS. 3 and 6 show an instant immediately after severing end portions of yarn ends, and FIGS. 4 and 7 show a final position of the preparation nozzles; and FIGS. 8, 9 and 10 are each fragmentary, perspective views of an exemplary embodiment with a loop puller, wherein FIG. 8 shows a situation after placement of the yarn, FIG. 9 shows an instant immediately after severing end portions of yarn ends, with a loop formed in each case, and FIG. 10 shows a final position of the loop pullers.

Referring now to the figures of the drawings in detail and first, particularly, to the exemplary embodiment of FIG. 1 thereof, there is seen a bobbin winder or winding machine 1. One of the winding stations 2 of the bobbin winder is shown with its most important features. Only those features that are necessary for an explanation and comprehension of the invention are shown.

A yarn 4 is drawn off from a payout bobbin 3 in a payout position and runs over a balloon breaker 5 and a yarn eyelet 6 to a yarn tensioner 7. A splicer 8 is disposed between the yarn tensioner 7 and a yarn monitor 9. During the takeup of the yarn, the yarn follows a path or course shown at reference numeral 4'. Associated with the yarn monitor 9 are yarn shears 10, which cut the yarn whenever the yarn monitor 9 detects a deviation from a predetermined standard. The yarn monitor 9 and the yarn shears 10 are optionally followed by a paraffin applicator 11. The yarn runs from the paraffin applicator 11 over a guide plate 12 onto a grooved drum 13, which simultaneously drives a cross-wound bobbin or cheese 14 and lays the yarn in cross-wound layers on the cheese. The cheese 14 is supported by a bobbin holder 15.

In the present exemplary embodiment, the yarn travel is to be interrupted between the payout bobbin 3 and the cheese 14. This kind of interruption of the yarn travel occurs whenever the yarn has broken, a change of payout bobbins has been completed, or a completely wound cheese has been changed. Joining yarn ends of the cheese 14 or of a newly mounted tube with a yarn reserve to a yarn end of the payout bobbin, is effected in the splicer 8. In order not to impede yarn travel during normal winding operation, the splicer 8 is set back with respect to the yarn travel path 4'. The yarn ends must therefore be placed in the splicer 8 in order to make a splice. To this end, a pivot nozzle 16 with a suction slit 17 is provided for an upper yarn. In order to provide for the payout of the upper yarn from the cheese 14, the pivot nozzle 16 pivots about a swivel joint 18 thereof into a position 16' shown in phantom. In this position 16', the suction slit is in a position 17', near the surface of the cheese 14. The yarn end is aspirated through the suction slit from the cheese 14 which is driven counter to the winding direction. The pivot nozzle 16 thereupon pivots back into its starting position. The aspirated yarn end, that is an upper yarn **4*o*, is guided over a circular arc 19, and in the process it is placed not only into the guide plate 12, the paraffin application 11, the yarn scissors 10, and the yarn monitor 9, but also into the splicer 8**.

A lower yarn **4*u* is aspirated by a suction tube 20 below the yarn tensioner 7. To this end, the suction tube 20 pivots about a swivel joint 22 out of its position of repose shown in FIG. 1, into a position 20'. A suction opening 21 in the suction tube 20 is then in a position 21' in front of the yarn and it aspirates it from the yarn tensioner, which then opens, and pivots back about the swivel joint 22 into its starting position, along a circular arc 23. During this process, the lower yarn 4*u* is placed in the opened yarn tensioner 7 and in the splicer 8**.

The preparation of the yarn ends for the splicing process, which is known from the prior art, will be described below in further detail in terms of the following exemplary embodiments.

The splicers shown in FIGS. 2–10 are known from the prior art, except for the features according to the invention. In the versions shown, they are equivalent to the Autoconer bobbin winders manufactured by the firm Schlafhorst in Mönchengladbach, Germany. The present illustrations are largely equivalent to those given in the operating manual for that machine. In the present exemplary embodiments, only those parts of the splicers that are needed for a perfect comprehension of the invention are shown.

FIG. 2 shows an exemplary embodiment with a splicer 8 having pivotable preparation nozzles. The situation that prevails after the placement of the upper and lower yarn in the splicer is shown.

The pivot nozzle 16 has pivoted back to its starting position. The pivot nozzle 16 has placed the aspirated upper yarn **4*o* in the splicer 8 with the suction slit 17. The suction tube 20 has likewise returned to its starting position and has placed the lower yarn 4*u* held in its suction opening 20, in the splicer 8** as well.

The yarns are located side by side in a splicing channel 26 of a splicer head 25. Yarn guide baffles 27 above the splicer head 25 and baffles 28 and 29 on the splicer head below the splicing channel 26, assure that the yarns are suitably associated with devices that are provided for preparation and splicing. The upper yarn is placed in a yarn clamp 30, in the splicing channel 26, and in a pair of shears 32 located below it and serving as a cutting tool, through the use of the yarn guide baffles 27 and 29. The lower yarn **4*u* is placed in a yarn clamp 34, in the splicing channel 26 and in a pair of shears 36 serving as a cutting tool, through the use of the yarn guide baffles 28 and 29**. The yarn clamps and shears are still open at the instant that the yarn is placed in these devices.

For the sake of simplicity, catch hooks, loop pullers and feed devices, along with a lid for closure of the yarn splicing channels are not shown in this or subsequent embodiments. Since they are already known and are of importance only for the splicing process that follows the preparation of the yarn ends, they need not be shown and their mode of operation need not be described in this case.

Preparation nozzles 38 and 45 for preparing the yarn ends for the splicing process ar pivotably disposed. The preparation nozzle 38 for the upper yarn **4*o* has a suction opening 39 aimed at a point of the shears 32 at the which the upper yarn is severed. The preparation nozzle 38 is supported in a swivel joint 40 that is located between the splicer head 25 and the shears 32, and is offset from the yarn travel. The swivel joint 40 is supported by a bearing 41 on the splicer 8. In order to provide for swiveling the preparation nozzle an actuating lever 42 engages it in the bearing 41. A blower nozzle 43 discharges into the preparation nozzle 38, just below the suction opening 39. Compressed air is blown into the preparation nozzle through a non-illustrated supply line, in order to aspirate the yarn ends through a negative pressure present at the suction opening, to release them from their yarn twist, and to thus prepare them for the splicing process by so-called unraveling. A suction line 44 which is also supported by the bearing 41, serves to remove the fibers by suction during preparation of the yarn ends. The suction line 44** can be connected to a non-illustrated negative pressure source of the machine. In that case, a suction flow prevails in the preparation nozzle independently of the blown-in compressed air.

The configuration of the preparation nozzle 45 for the lower yarn **4*u* has an identical type of structure. Once again, the suction opening of the preparation nozzle is aimed at a point of the shears 36 at which the yarn is severed. The preparation nozzle 45 is pivotable about a swivel joint 47, which is supported by a bearing 48. An actuating lever 49 engages the preparation nozzle 45 in this bearing and the nozzle is swiveled with this lever. A blower nozzle 50 discharges into the preparation nozzle 45 just below the suction opening 46 and as with the above-described preparation nozzle, compressed air can again be blown into the blower nozzle in order to aspirate the yarn ends to be prepared, to free them from their twist, and to unravel them. In order to provide for aspiration of the yarn end, a negative pressure can also be applied to the preparation nozzle 45, through a suction line 51 which is supported by the bearing 48. The negative pressure is generated by an external vacuum source, so that a flow of suction is created at a suction opening 46, independently of the blown-in compressed air. The actuating levers 42 and 49** are actuated by an actuating apparatus, which is not shown nor described in further detail herein. The execution of the swiveling motion can be effected through a non-illustrated control device, with which the other actuating levers and the other component units of the splicer are actuated as well.

FIG. 3 shows a method step that follows the one shown in FIG. 2. First, the yarn clamps 30 and 34 are closed through respective actuating levers 31 and 35, and move to positions 30' and 34'. As a result, the upper yarn **4*o* and the lower yarn 4*u* are each firmly clamped. The yarns and the yarn ends are held taut through the use of the suction flows still prevailing at the pivot nozzle 16 and the suction tube 20. The shears 32 and 36 are then actuated simultaneously through respective actuating levers 33 and 37. An end portion 4***o*' of the upper yarn which is located in the suction slit 17 of the pivot nozzle 16, is cut off and removed by suction as waste. The end portion 4*u*' of the lower yarn, which had been aspirated by the suction tube 20, is likewise cut off and likewise removed by suction as waste. The result is new yarn ends for both the upper and lower yarns. Since a negative pressure is generated in the preparation nozzles 38 and 45 and the suction openings 39 and 46 are aimed directly at the points at which the respective yarns have been severed, the newly created yarn ends are aspirated directly by the suction openings.

The aspiration of the newly created yarn ends is effected in such a way that the yarn end of the upper yarn 4*o* is aspirated into the preparation nozzle 38 with a cut edge 4*ox* thereof leading. The newly created yarn end of the lower yarn 4*u* is aspirated into the preparation nozzle 45 with a cut edge 4*ux* thereof leading. As a function of the cutting tools, after they have been actuated or in other words after the yarns have been cut, the actuating lever 42 for the preparation nozzle 38 and the actuating lever 49 for the preparation nozzle 45 are actuated simultaneously in such a way that both preparation nozzles are swiveled in the direction of the splicer head 25. At the same time, the compressed air is blown in through the blower nozzle 43 in the preparation nozzle 38 and through the blower nozzle 50 in the preparation nozzle 45, in order to unravel the yarn ends, beginning at the respective cut edges 4*ox* and 4*ux*, with these ends having been aspirated deeper and deeper into the preparation nozzles because of the negative pressure applied and because of the swiveling motion. Since the unraveling proceeds from the cut edge outward, uniform untwisting is effected, and loose fibers are blown away or removed by suction, so that they do not hinder the unraveling process.

In the method according to the invention, the yarn ends remain stationary in the splicing channel after being cut prior to and during their entry into the preparation nozzles and during the entire preparation process. As a result, the two yarn ends need not slide past one another, thereby preventing them from catching on one another and thus preventing different yarn lengths from being aspirated into the respective preparation nozzles. Beginning at the cut edge, the yarn ends are always prepared to a length that matches each other. This assures optimal, uniform unraveling of the yarn ends.

FIG. 4 shows the moment in the method at which the preparation of the yarn ends have been completed. The preparation nozzles 38 and 45 have been swiveled into respective end positions 38' and 45'. The pivot angle of the preparation nozzles, the swiveling speed, and the intensity of the air blown in through the blower nozzles can be adapted to the particular yarn parameters. The pivot angle determines the length of the yarn end that is to be unraveled. It is thus possible to predetermine how far the respective yarn ends are aspirated and thus unraveled, by swiveling the preparation nozzles. The adjustment of the pivot angle of the preparation nozzles is not shown in further detail in this case. The pivot angle of the respective preparation nozzles 38 and 45 is determined in accordance with how far the particular actuating lever 42 or 49 is drawn to the left or right in the direction of an arrow by the respective actuating apparatus. It is conceivable to provide adjustable mechanical stops to limit the swivel path of the preparation nozzles.

Once the preparation of the yarn ends has been completed, the supply of compressed air to the blower nozzles is shut off. Non-illustrated loop pullers above and below the splicer head each pull the prepared yarn end which located on the far side of the splicer head, into the splicing channel in such a way that the yarn ends lie side by side. The splicing process then ensues.

The exemplary embodiment of FIGS. 5, 6 and 7 shows a splicer with displaceable preparation nozzles. Characteristics that match those of the above-mentioned exemplary embodiment are identified by the same reference numerals.

FIG. 5 shows the moment at which the upper yarn 4*o* has been placed by means of the pivot nozzle 16, and the lower yarn 4*u* has been placed by means of the suction tube 20, in the splicing channel 26 of the splicer head 25 of the splicer 8. The yarn clamps 30 and 34 and the shears 32 and 36 are still open.

A preparation nozzle 55 for the upper yarn and a preparation nozzle 62 for the lower yarn are respectively disposed in such a way that they are displaceable between the shears 32 and 36, and the splicer head 25.

The preparation nozzle 55 has a suction opening 56 aimed at a point of the upper yarn 4*o* at which the upper yarn 4*o* is cut by the shears 32. The preparation nozzle 55 is secured to a lifting element 57 that has two compressed air connections 58*a* and 58*b* for back and forth movement of a piston located therein and thus of the preparation nozzle connected thereto. The preparation nozzle 55 is guided in a guide rail 59 with a direction of motion which is parallel to the path or course of the upper yarn. The preparation nozzle has a blower nozzle 60, through which compressed air is blown to aspirate the yarn ends and to unravel the yarn twist of the aspirated yarn end during the preparation. Adjoining the end of the preparation nozzle is a suction line 61, which in the present case is flexible. The fibers produced in the preparation process are carried away through this suction line.

The preparation nozzle 62 for the lower yarn 4*u* has the same structure as the preparation nozzle 55. The preparation nozzle 62 likewise has a suction opening 63 aimed at a point of the lower yarn 4*u* at which the shears 36 sever the lower yarn The preparation nozzle 62 is carried by a lifting element 64, which has compressed air connections 65*a* and 65*b* for intended upward and downward motions in a guide rail 66. A blower nozzle 67 serves to deliver compressed air for aspirating and preparing the yarn ends. A flexible suction line 68 carries away fibers produced in the preparation.

FIG. 6 shows the moment at which the yarn clamps and the yarn shears have been actuated. Through the use of the actuating lever 31, the yarn clamp 30 for the upper yarn 4*o* has been pivoted into the position 30' and then clamps the upper yarn therein. At the same time, through the use of the actuating lever 33, the shears 32 have been moved into the position 32' and have cut the end portion 4*o*', which has been carried away by suction through the suction slit 17 of the pivot nozzle 16. The yarn clamp 34 has been moved into the position 34' by the actuating lever 35 and thus clamps the lower yarn 4*u*. The shears 36 had been closed by the actuating lever 37 and moved to the position 36', as a result of which the end portion 4*u*' of the lower yarn had been cut off. The end portion is removed by suction through the suction opening 21 of the suction tube 20. After the upper yarn has been cut, the yarn end is aspirated into the preparation nozzle 55, with its cut edge 4*ox* leading. The yarn end of the lower yarn is aspirated through the suction opening 63 into the preparation nozzle 62, with its cut edge 4*ux* leading.

The lifting elements 57 and 64 are then actuated. To this end, compressed air is fed to the pistons in the cylinders of the various lifting elements through the respective compressed air connections 58*a* and 65*a*. As a result, the preparation nozzles 55 and 62, guided by the respective guide rails 59 and 66, move toward the splicer head 25. The suction openings 56 and 63 substantially follow the path or course that the yarns had previously taken. At the same time, compressed air for unraveling the yarn twist is blown into the various preparation nozzles through the respective blower nozzles 60 and 67. Fibers that have been separated from the composite fiber structure are removed through the suction lines 61 and 68. To the extent that the preparation nozzles 55 and 62 move toward the splicer head 25, the yarn ends are aspirated with their cut edges leading, that is the upper yarn is aspirated with its cut edge 4*ox* into the preparation nozzle 55 and the lower yarn is aspirated with its cut edge 4*ux* into the preparation nozzle 62. As a result, they are prepared for the splicing process beginning at the cut edge. The length of the yarn end that is subjected to the preparation depends on how far the preparation nozzles move toward the splicer head. By controlling the supply of compressed air to the compressed air connections 58*a* and 65*a*, the distance that the preparation nozzles travel and as a result the length of the yarn ends that is prepared, can be determined.

Once the optimal yarn length has been prepared, the delivery of compressed air to the compressed air connections 58*a* and 65*a* and to the blower nozzles 60 and 67 is stopped. The preparation nozzles then remain in the position they have attained. This is shown in FIG. 7. The preparation nozzle 55 assumes a position 55', and the suction nozzle 56 is in a position 56'. The preparation nozzle 62 has reached the position 62', and the suction nozzle 63 has reached the end position 63'.

The prepared yarn ends are then drawn out of the preparation nozzles and into the splicing channel by non-illustrated loop pullers, in the manner known from the prior art. Once the two prepared yarn ends are located side by side in the splicing channel, the splicing process is initiated.

The compressed air connections 58*b* and 65*b* can thereupon be acted upon by compressed air, in order to actuate the respective lifting elements 57 and 64 and move the preparation nozzles 55 and 62 into their respective starting positions. .

The lifting elements may be actuated hydraulically instead of pneumatically. Other actuating elements are also conceivable, such as electromechanical drive mechanisms or servomotors.

During the entire preparation process of the yarn ends, they remain stationary in the splicing channel 26 of the splicer head 25. During the aspiration into the preparation nozzles, the yarn ends do not move past one another.

In the description of the above-mentioned exemplary embodiments, the situation has not been shown in which the preparation nozzles assume a position in which the suction openings are each located directly above or below the splicer head and oriented toward the respective end of the splicing channel, after completion of yarn end preparation. As already explained, in such a position of the preparation nozzles, it is possible even for yarns that are difficult to manipulate to be brought securely into the splicing channel and spliced.

The exemplary embodiment of FIGS. 8, 9 and 10 shows a rigid configuration of the preparation nozzles and one respective loop puller between each of the preparation nozzles and the splicer head. Characteristics that match those of the above-described exemplary embodiments are identified by the same reference numerals.

In FIG. 8, a situation is shown at the moment at which the upper yarn 4*o* and the lower yarn 4*u* have been respectively placed in the splicing channel 26 in the splicer head 25 of the splicer 8 by means of the pivot nozzle 16 and the suction tube 20. The yarn clamps 30 and 34 and the shears 32 and 36 are still open. A preparation nozzle 70 is disposed in a stationary manner above the shears 32, as viewed in the direction toward the splicer head 25. A suction opening 71 of the preparation nozzle 70 is aimed at the point of the upper yarn 4*o* at which the yarn is cut by the shears 32. The preparation nozzle 70 has a blower nozzle 72, through which compressed air is blown in during the aspiration and unraveling of the yarn ends. Fibers loosened from the composite fiber structure are removed through a suction line 73. The suction line 73 can also be connected to a non-illustrated source of negative pressure, as a result of which suction prevails at the suction opening 71, independently of the blowing in of the compressed air.

A preparation nozzle 78, which has a suction opening 79 aimed at the point of the lower yarn 4*u* at which it is severed by the shears 36 is located directly below the shears 36, as viewed in the direction toward the splicer head 25. This preparation nozzle likewise has a blower nozzle 80, through which compressed air is blown for aspiration and preparation of the yarn ends. A suction line 81 can likewise be connected to a non-illustrated negative pressure source. In that case, the negative pressure source provides for suction at the suction opening 79 and for removal of fibers loosened from the yarn ends during the preparation, through the suction line 81, independently of the compressed air.

One respective loop puller 74 and 82 is disposed between the splicer head 25 and each of the shears 32 and the shears 36. The loop puller 74 includes a lifting cylinder 75 with compressed air connections 76*a* and 76*b*. The loop puller 82 includes a lifting cylinder 83 with compressed air connections 84*a* and 84*b*. A piston moves back and forth inside the lifting cylinder, depending on which of the compressed air connections is acted upon with compressed air. The piston is not shown in this case, because lifting cylinders are known in the prior art. A draw hook 77 protrudes from the lifting cylinder 75, and a draw hook 85 protrudes from the lifting cylinder 83.

Since the preparation nozzles 70 and 78 remain stationary, the loop pullers assure that the yarn length which is optimal for preparation purposes is aspirated into the preparation nozzles and prepared there.

To this end, as shown in FIG. 9, a loop is first formed in each yarn end, by moving the draw hook 77 to a position 77' and moving the draw hook 85 to a position 85'. To this end, the compressed air connections 76*a* and 84*a* are acted upon by compressed air. The upper yarn forms a yarn loop 4*os* and the lower yarn forms a yarn loop 4*us*. The yarn ends remain stationary in the splicing channel, at least from the instant at which the yarn ends have been placed in the splicing channel 25. During the preparation, they do not move past one another.

In FIG. 9, the shears 32 have been actuated and moved to the position 32'. The end portion 4*o'* of the upper yarn has been severed and is removed by suction through the suction slit 17 of the pivot nozzle 16. Due to the suction prevailing at the suction opening 71, the yarn end of the upper yarn is aspirated into the preparation nozzle 70 with its cut edge 4*ox* leading.

The shears 36 have also been actuated and moved to the position 36'. The end portion 4*u'* of the lower yarn is removed by suction through the suction tube 20. The yarn end is aspirated into the preparation nozzle 78 with its cut edge 4*ux* leading, since suction likewise prevails at the suction opening 79.

At the instant at which the end portions of the yarn ends have been cut off and the yarn ends enter the suction openings with their cut edges leading, the loop pullers are actuated. The loop puller 74 is retracted from its position 74' to its base position far enough to ensure that a piece of the upper yarn of optimal length for the preparation is aspirated into the preparation nozzle 70. To this end, compressed air is blown into the lifting cylinder 75 through the compressed air connection 76*b*. While the loop 4*os* of the upper yarn is being unraveled, compressed air for preparing the yarn end of the upper yarn, beginning at its cut edge 4*ox*, is simultaneously blown in through the blower nozzle 72.

The yarn end of the lower yarn is prepared by the same method. In this case the lifting cylinder 83 is actuated by subjecting the compressed air connection 84*b* to compressed air. As a result, the draw hook is displaced out of its position 85' back into its outset position, as a result of which the loop 4*us* formed by the lower yarn is unraveled. The yarn end is aspirated into the preparation nozzle 78, with its cut edge 4*ux* leading. Simultaneously, compressed air is blown in through the blower nozzle 80, to prepare the yarn end beginning at its cut edge. Once again, the loop puller releases the draw hook far enough to ensure that an optimal yarn length for preparation of the yarn end has been aspirated by the preparation nozzle.

During the yarn end preparation, the yarns remain stationary in the splicing channel of the splicer head. Once the preparation of the yarn ends has been completed, the compressed air at the blower nozzles is switched off, and the prepared yarn ends are drawn into the splicing channel by non-illustrated loop pullers, until they rest side by side. The splicing process is then performed in a known manner.

Instead of actuating the loop pullers with lifting cylinders acted upon by compressed air, this actuation can be performed with hydraulic lifting cylinders, electromechanical drive mechanisms, or servomotors.

In splicers that are capable of occupying only a limited amount of space vertically, a very compact structure is possible for performing the method of the invention with the aid of loop pullers. As a result, the preparation nozzles can be disposed quite close to the splicer head.

Once the yarn end preparation according to the method of the invention has been completed, the spliced connection is made, and the yarn is returned to the path or course that it assumes in rewinding, as indicated at reference numeral 4' in FIG. 1.

I claim:

1. A method for preparing two yarn ends to be joined together, which comprises:

placing two yarns to be joined together by pneumatic splicing in a splicer head of a splicer with ends of the yarn to be prepared protruding out of a splicing channel of the splicer head in mutually opposite directions;

holding the yarn ends taut at given points;

orienting suction openings of preparation nozzles toward the cutting tools;

applying a flow of suction to the suction openings; subsequently shortening the yarn ends protruding from the splicing channel to a length required for a splicing process by cutting off portions of the yarn ends between the given points and the splicer head and producing cut edges;

aspirating the yarn ends to be prepared with the cut edges leading into the respective preparation nozzles at a predetermined speed;

pneumatically unravelling twists in the yarn ends beginning at the cut edges with compressed air during the aspiration into the preparation nozzles;

maintaining the yarns in the splicing channel stationary relative to one another and to the splicing channel during the pneumatic unraveling;

aspirating the yarn ends far enough to prepare a yarn length for splicing being optimally matched to applicable yarn parameters while a not-unraveled portion of the yarns remains stationary in the splicing channel; and adapting a duration and intensity of preparation of the yarn ends to the yarn parameters.

2. The method according to claim 1, which comprises:

placing the preparation nozzles in a position directly below cutting tools with each preparation nozzle between a respective cutting tool and the splicer head, prior to cutting off the end portions of the yarn ends;

moving the suction openings of the preparation nozzles toward the splicer head after the end portions are cut off and the yarn ends to be prepared have been aspirated;

aspirating the yarn ends in to the preparation nozzles with the cut edges leading due to the motion of the preparation nozzles; and stopping the motion of the preparation nozzles once the optimal yarn length for a given yarn end preparation situation has been-aspirated.

3. The method according to claim 2, which comprises pivoting the suction openings of the preparation nozzles out of the position below the cutting tools toward the splicer head.

4. The method according to claim 3, which comprises limiting the pivoting of the preparation nozzles during the preparation of the yarn ends enough to prevent oppositely oriented components of motions of the suction openings and the yarn to reverse direction.

5. The method according to claim 2, which comprises displacing the preparation nozzles out of the position below the cutting tools toward the splicer head with the suction openings substantially following respective paths of the previously tautly held yarn ends.

6. The method according to claim 2, which comprises moving the preparation nozzles to a position in which the suction openings are respectively disposed directly above and below the splicer head and oriented toward respective ends of the splicing channel, after completion of the preparation of the yarn ends; continuing suction at the suction openings while the prepared yarn ends are aspirated out of the preparation nozzles into the splicing channel; and then performing the splicing process.

7. The method according to claim 2, which comprises drawing lops between the respective cutting tools and the splicer head prior to cutting off the end portions, with free yarn ends protruding from the splicer head and each loop including a length of yarn equivalent to a yarn length to be prepared for splicing; and unravelling the loops after the end portions have been cut off for aspirating the yarn ends to be prepared into the respective preparation nozzles in the yarn length to be prepared and with the cut edges leading.

8. In a splicer for pneumatically splicing yarn ends, including a splicer head with a splicing channel for receiving yarn ends to be spliced, cutting tools for cutting off end portions of the yarn ends at a given point along each of the yarn ends and at a given instant of actuation, and preparation nozzles having suction openings and being respectively disposed above and below the splicer head for pneumatically unravelling a yarn twist, an apparatus for preparing two yarn ends to be joined together, comprising means for locating the preparation nozzles directly at the cutting tools and between the cutting tools and the splicer head at least at the given instant of actuation, with each of the suction openings aimed directly at a respective one of the given points, and means for maintaining the yarns in the splicing channel stationary relative to one another while preparing the two yarns ends.

9. The apparatus according to claim 8, wherein said locating means include means for swiveling the preparation nozzles back and forth between the respective cutting tools and the splicer head.

10. The apparatus according to claim 8, wherein said locating means include means for displacing the preparation nozzles back and forth between the respective cutting too and the splicer head.

11. The apparatus according to claim 8, including loop pullers each being disposed between a respective one of the cutting tools and the splicer head for forming a yarn loop in the yarn end to be prepared, with a length of the yarn in the loop being equivalent to the yarn length to be prepared and optimally adapted to respective yarn parameters; and means for controlling said loop pullers in dependence on the cutting tools for unraveling the loops.

12. An apparatus for preparing and splicing two yarn ends to be joined together, comprising a splicer for pneumatically splicing yarn ends, said splicer having a splicer head with a splicing channel for receiving yarn ends to be spliced, cutting tools for cutting off end portions of the yarn ends at a given point along each of the yarn ends and at a given instant of actuation, preparation nozzles having suction openings and being respectively disposed above and below said splicer head for pneumatically unraveling a yarn twist, for locating said preparation nozzles directly at said cutting tools and between said cutting tools and said splicer head at least at said given instant of actuation, with each of said suction openings aimed directly at a respective one of said given points, and means for maintaining the yarns in said splicing channel stationary relative to one another while preparing the two yarns ends.

* * * * *